US006560794B2

(12) United States Patent
Allen et al.

(10) Patent No.: US 6,560,794 B2
(45) Date of Patent: May 13, 2003

(54) RISE ASSIST APPARATUS

(76) Inventors: Kyle R. Allen, 2413 Crosscreek Trail, Cuy. Falls, OH (US) 44223; Lynn W. Allen, 2413 Crosscreek Trail, Cuy. Falls, OH (US) 44223

( * ) Notice: Subject to any disclaimer, the term of this patent is extended or adjusted under 35 U.S.C. 154(b) by 0 days.

(21) Appl. No.: 09/923,295

(22) Filed: Aug. 6, 2001

(65) Prior Publication Data

US 2002/0083523 A1 Jul. 4, 2002

Related U.S. Application Data

(60) Provisional application No. 60/222,838, filed on Aug. 4, 2000.

(51) Int. Cl.[7] ..... A61G 7/08

(52) U.S. Cl. ..... 5/81.1 R; 5/662; 5/503.1; 5/507.1; 248/131; 248/132; 248/157

(58) Field of Search ..... 5/81.1 R, 503.1, 5/507.1, 662, 658; 248/694, 131, 132, 298.1, 157, 159, 410

(56) References Cited

U.S. PATENT DOCUMENTS

| | | | | | |
|---|---|---|---|---|---|
| 1,231,452 | A | | 6/1917 | Sword | |
| 2,057,811 | A | * | 10/1936 | Armstrong | 5/662 |
| 2,490,130 | A | * | 12/1949 | Hollis | 5/85.1 |
| 2,981,959 | A | | 5/1961 | Burnham | |
| 3,085,258 | A | | 4/1963 | Wolferts | |
| 3,176,322 | A | | 4/1965 | Mulcahy | |
| 3,394,933 | A | * | 7/1968 | Benoit | 482/67 |
| 3,553,746 | A | | 1/1971 | Seiger | |
| 4,932,090 | A | | 6/1990 | Johansson | |
| 4,964,182 | A | * | 10/1990 | Schmerler | 135/67 |
| 5,217,033 | A | | 6/1993 | Herman, Jr. | |
| 5,257,426 | A | * | 11/1993 | Leoutsakos | 248/220.1 |
| 5,305,773 | A | * | 4/1994 | Browning | 135/65 |
| 5,335,385 | A | | 8/1994 | Brown | |
| 5,337,430 | A | | 8/1994 | Schlein | |
| 5,384,927 | A | | 1/1995 | Mardero et al. | |
| 5,394,581 | A | | 3/1995 | Leoutsakos | |
| 5,400,450 | A | | 3/1995 | Leoutsakos | |
| 5,465,744 | A | * | 11/1995 | Browning | 135/67 |
| 5,560,053 | A | * | 10/1996 | Mills | 135/65 |
| 5,586,352 | A | | 12/1996 | O'Brien et al. | |
| 5,983,421 | A | * | 11/1999 | Walser | 135/66 |
| 6,012,182 | A | | 1/2000 | Allen et al. | |
| 6,039,293 | A | * | 3/2000 | Minet | 248/125.8 |
| 6,058,527 | A | * | 5/2000 | Charpin | 5/81.1 RP |
| 6,068,225 | A | * | 5/2000 | O'Brien et al. | 248/200.1 |

* cited by examiner

*Primary Examiner*—J. J. Swann
*Assistant Examiner*—Katherine Mitchell
(74) *Attorney, Agent, or Firm*—Scott M. Oldham; of Hahn, Loeser & Parks, LLP

(57) ABSTRACT

A rise assist apparatus comprising a handrail in the form of a convoluted section attached to a vertical pole, and stabilized by a bed frame attachment member and a floor contacting base frame. Alternatively, the rise assist apparatus may be wall mounted, being stabilized by a system of mounted wall brackets. The rise assist apparatus further includes an upper curved, horizontal leveraging handle, which extends from the pole-like support structure. Specifically, the rise assist apparatus allows the user to build momentum by pushing off the upper hand grip, and allows the user to control the momentum by regaining balance, and readjusting posture, by gripping the lower handrail member. Additionally, the user can use the curved grip with one hand, while simultaneously reaching for the handrail during the rising movement thereby allowing the user to support himself or herself as they rise out of bed.

14 Claims, 7 Drawing Sheets

RISE ASSIST APPARATUS

This application claims the benefit of Provisional application Ser. No. 60/222,838, filed Aug. 4, 2000.

TECHNICAL FIELD

This invention relates generally to a support device, which can be attached to a bed frame or wall to permit self-assisted movement from a supine and/or seated or like position, such as movement into and out of a bed or chair. More particularly, the invention relates to a support device, which capitalizes on the kinesiology of movement into and out of a seated or lowered position, to a standing position.

BACKGROUND OF THE INVENTION

A significant portion of the population has difficulty transferring himself or herself into and out of a seated or lowered position to a standing position, such as from a bed or chair. Such difficulties can be attributed to muscular trauma or illness, recuperation from debilitating disease, or age-related degeneration of muscles and body movement. One factor that is currently assessed when evaluating an individual's health care status, is the ability to rise independently from a bed. Consequently, a device to provide unassisted use of a bed, chair, toilet, or the like, could increase a disabled or elderly person's quality of life and provide them with a higher degree of independence as well.

Recent studies have shown that older patients are more likely to rotate and laterally flex their trunks to alter pivot-related motions when rising from supine to seated positions. Additionally, large numbers of such patients are more likely than comparably studied younger groups, to broaden their support base by contacting their elbow to the horizontal surface during middle trunk elevation when rising from a supine to a sitting position. Similarly, older adults are more likely to utilize their hands or a flexed leg to assist in pulling themselves into a sitting position.

The present invention is a pole-like device that derives its vertical stability from both a base system as well as a bed frame, wall or like support attachment. This stability facilitates supplying manual assistance for a patient getting into or out of a bed, chair, or the like. The device enables the user to achieve stable equilibrium for independent movement and functions to broaden the support base of the patient so as to provide a substitute for the use of an elbow or bent leg to assist in the rising motion.

The device has both an ergonomically designed handrail in the form of a convoluted tube and an elevated, curved handle that is attached to a pole-like projection mounted to a base system. The convoluted handrail provides optimal leverage to the user during rising movement and the curved handle enables the user to steady themselves as they rise from a bed, chair, or the like. The device may also be mounted to the wall, or other support surface, to assist at any desired location, such as adjacent a chair. The wall mounting system uses a series of adjustable brackets having holes that allow one to secure the pole to a wall or similar structure.

A further object of the invention is to provide a support which has spaced, convoluted hand grips and an angled handle to provide optimum leverage for the user to utilize back, shoulder, and arm muscle groups in self-assisted movement while getting into or out of a supine or seated position.

An additional object of the invention is to provide a relatively inexpensive, user-friendly support device which enables the user to be independent of the help of others for getting into and out of a supine or seated position.

SUMMARY OF THE INVENTION

A rise support device is provided which comprises a handrail in the form of a convoluted tube attached to a vertical pole stabilized by a bed frame and base frame. Alternatively, the device may be wall mounted, being stabilized by a system of mounted wall brackets. The device further includes a curved, horizontal leveraging handle portion, which extends from the pole-like support structure. The device allows the user the ability to build momentum by pushing off the upper hand grip and allows the user to control momentum by regaining balance as well as readjusting posture by gripping the lower handrail member. This function is necessary for the safe completion of rising from a bed or getting out of a chair. Also the user can push off the curved grip with one hand while simultaneously reaching for the convolution shaped handrail during the rising movement which enables the user to steady them as they climb out of bed.

The invention generally comprises a pole-like support member having a base handrail member that may be convoluted in form. This base handrail member is supported by a rod which generally projects into and parallel with the patient support surface. Because the base handrail member is desirably formed by a series of convolutions, it creates a plurality of vertical and horizontal grabbing surfaces. The device can be used for coming to a sitting position from a supine position, or from a seated position to a standing position. The support may also include an elevated handle, which can be gripped for pulling or pushing motion from a half-rise when rising from a chair. This handle can also be used to enable the user to pivot to a side-facing position in approaching the edge of the bed. The base may be secured by an L-shaped bracket, which is positioned under one side of a bed frame or the like, and by a floor-contacting H-frame base. Alternatively, when the pole support is used as an assistive device for a chair, the device is secured by both an adjustable floor base and a system of mounted wall brackets.

DETAILED DESCRIPTION OF THE DRAWINGS

Figure 1:
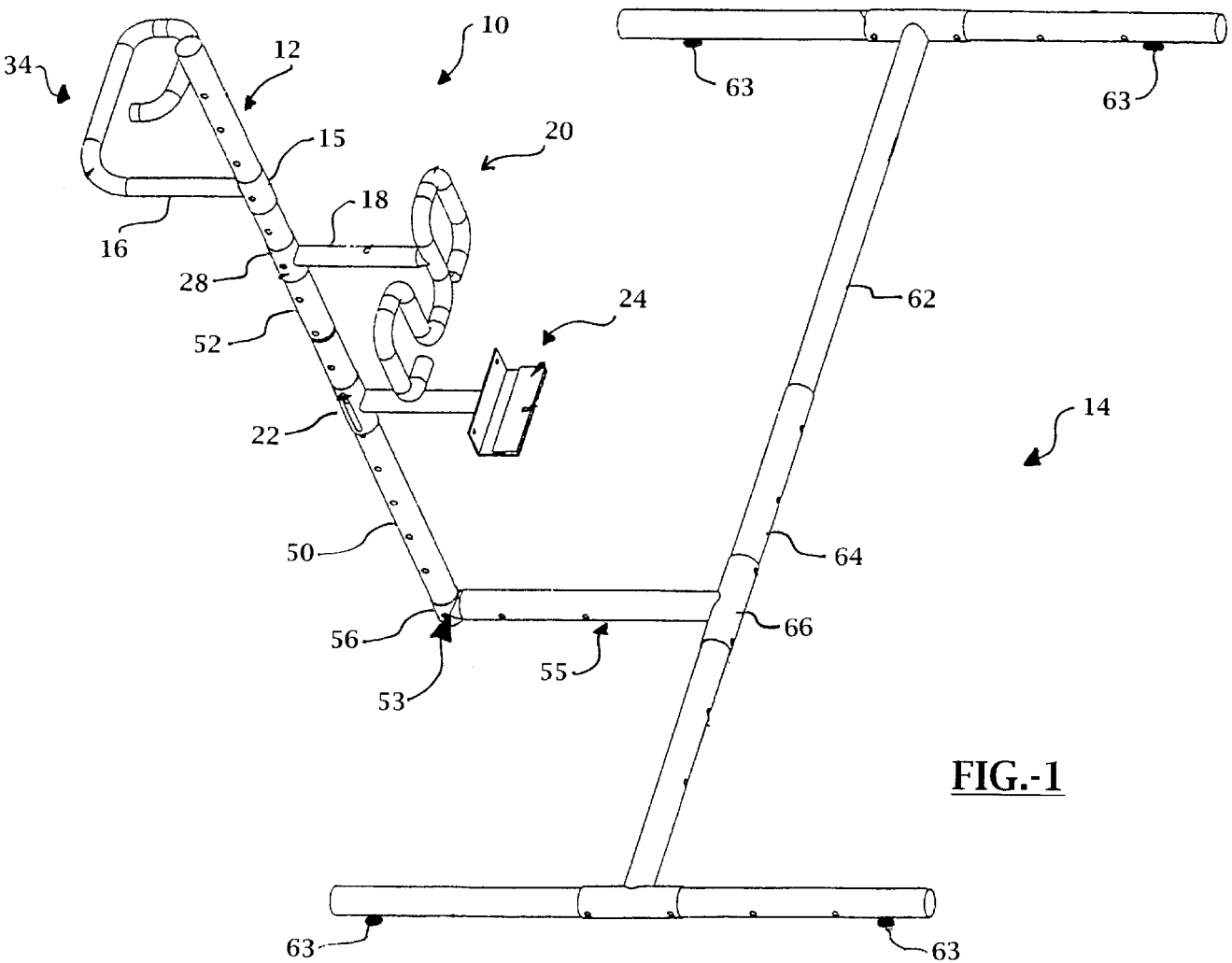
FIG. 1 is a perspective view of a rise assist apparatus in accordance with this invention.
Figure 2:
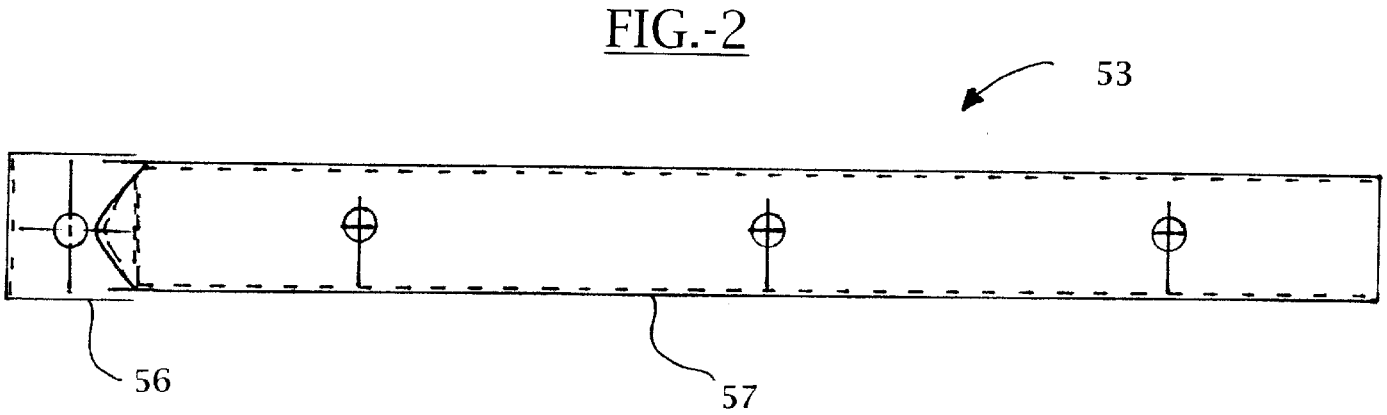
FIG. 2 is an elevational view of the pole support attachment and base attachment means.
Figure 3:
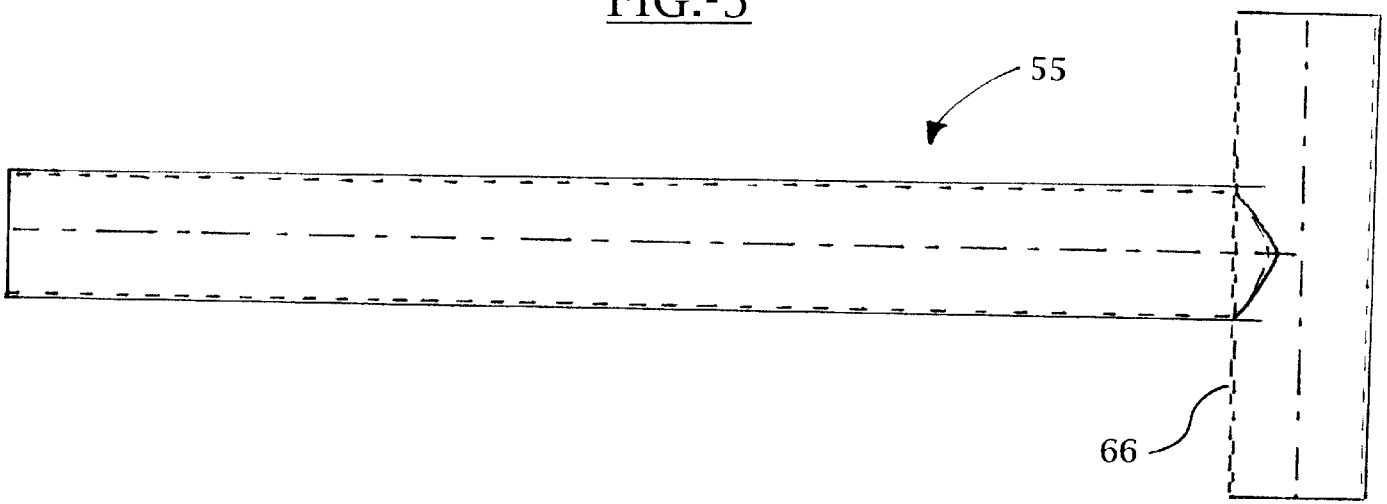
FIG. 3 is a top plan view of the H-frame base attachment and pole support attachment means.

FIG. 1 generally illustrates a rise support 10 in accordance with an embodiment of the invention, comprising a vertical support pole member 12. The pole member 12 may itself be comprised of two independent pole members: upper member 52 and lower member 50, if desired, allowing the device to be broken down for storage. This support pole member 12 is attached to a floor-contacting base 14, comprised in this embodiment by a series of interfitting tubular sections. Specifically, support pole member 12 inserts into an end collar 56 of the base attachment member 53, illustrated in FIG 2. FIG. 2 depicts the base attachment member 53, which has a tubular extension 57 that slides inside of an opposing tubular "T" member 55 shown in FIGS. 1, 3, and 4. This system of opposing, slideably adjustable members allows the user to increase or decrease the distance the support pole 12 is positioned in relation to the base 14. To fasten the members 53 and 55 together, the user may insert any suitable attachment means, such as a compression screw or removable pin in a provided hole system incorporated in the opposing members 53 and 55. In the embodiment shown, the floor contacting base or frame 14 is shaped into a stable H configuration but other suitable base frame configurations are possible.

Figure 4:
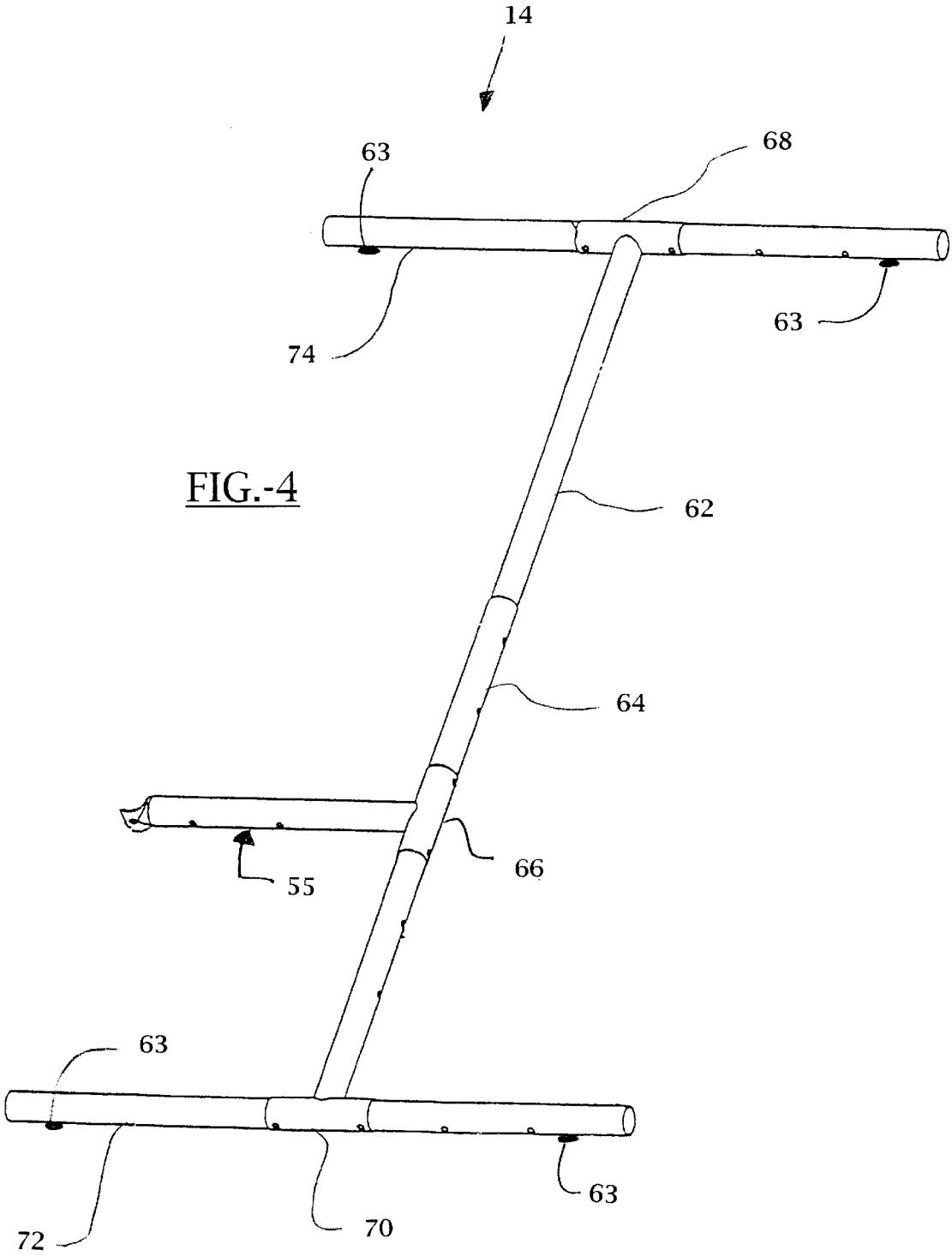
FIG. 4 is an elevational view of the H-frame base means, which is a part of the present invention.

Turning to FIG. 4, the "T" housing section 66 of "T" member 55 allows a smaller diameter "T" end tube 64 which is perpendicular to "T" member 55 to be slideably situated and adjusted in the housing section 66. This "T" end tube 64 is fastened to the housing section 66 by inserting any suitable attachment means, such as a compression screw or removable pin in the provided hole system incorporated into the housing section 66 and "T" end tube 64. Once "T" tube end 64 is inserted in and through tubular housing section 66, a similar opposing "T" end tube 62 is situated to slide inside of the tubular section provided by opposing "T" end tube 64. The opposing "T" tube ends 62 and 64 are fastened together by inserting any suitable attachment means, such as a compression screw or removable pin in the provided hole system incorporated in both "T" tube ends 62 and 64. Inserted through each opposing "T" end housing 68,70 of the H-base 14 resides parallel strut members 72,74 that are situated to provide vertical stability as well as a lower center of gravity for the support pole 12. These strut members 72 and 74 are slideably adjustable within their respective "T" end housings 68,70. Once positioned, the parallel strut members 72,74 are fastened to their corresponding "T" end housings 68,70 by inserting any suitable attachment means, such as a compression screw or removable pin in the provided hole system incorporated in both the "T" end housings 68,70 and the parallel strut members 72,74.

Figure 5:
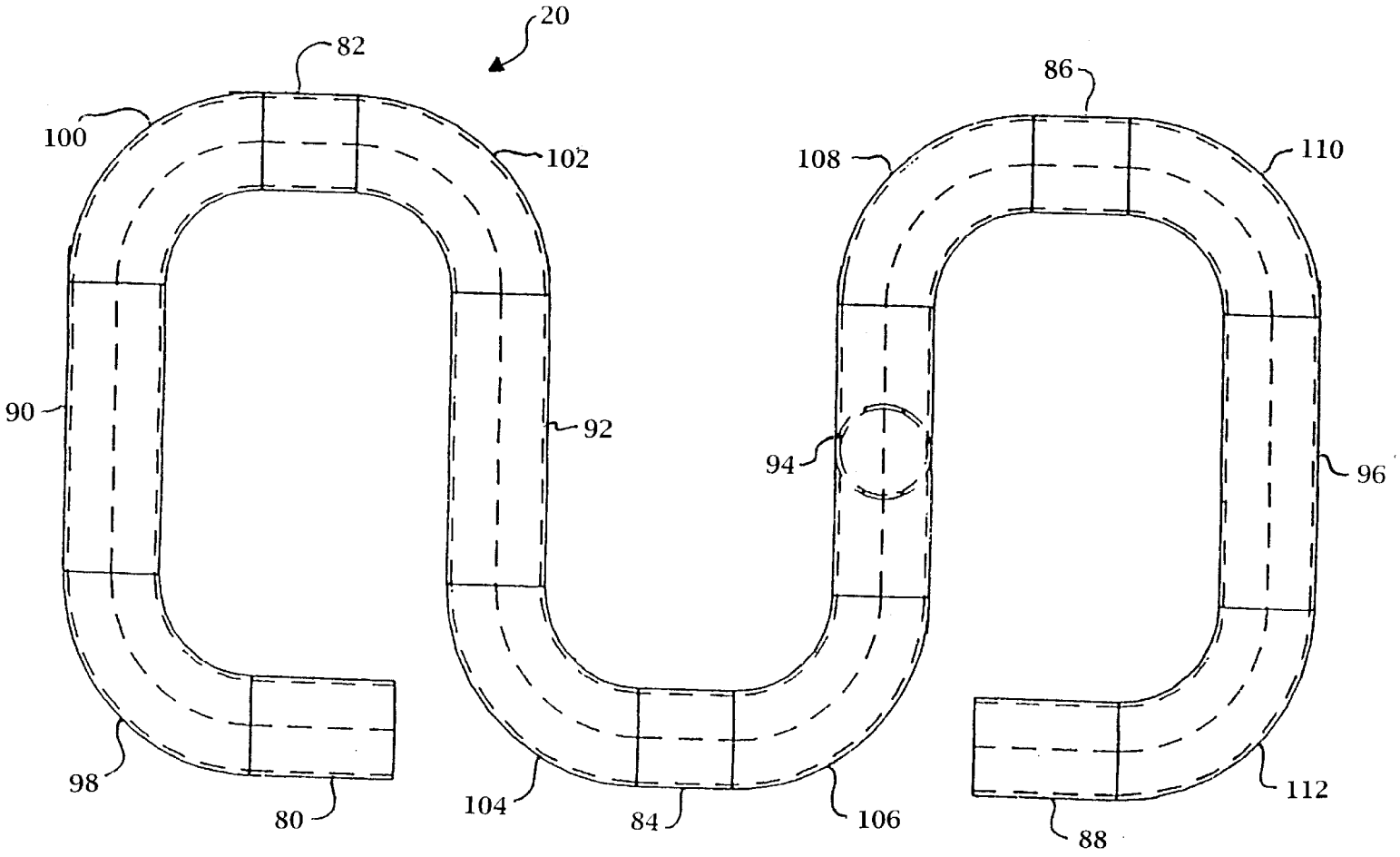
FIG. 5 is an elevational view of the first hand-assist means.

Returning to FIG. 1, rise support 10 includes a base handrail member 20 having a support rod 18 held by a collar 28 in an adjustable, locked position relative to the pole 12. In order to hold the base handrail member 20 in position relative to the pole and ultimately to a bed, a suitable attachment means, such as compression screw or removable pin, is inserted in the hole system integrated into the tubes. FIG. 5 illustrates the shape of the base handrail member 20, which takes the form of a pair of interconnected and spaced convolutions. Specifically, these tubular convolutions create a plurality of alternating grasping surfaces that include: substantially horizontal sections 80, 82, 84, 86, 88, curved sections 98, 102, 106, 110, substantially vertical 90, 92, 94, 96, and curved sections 100, 104, 108, 112. The base member 20 is typically much smaller than traditional frame-mounted bed rails. Further, base handrail member 20 serves as an aid for assisting a person into and out of bed, not a restraint device. Conventional bed rails may in fact impede mobility in transferring in and out of bed. The handrail member's support rod 18 is offset and is attached to the rear, center of vertical section 94. Support rod 18 is adjustable for various distances from the edge of the bed mattress inwards towards the person in the bed or outwards which permits personalized positioning. Support rod 18 also assists persons by providing a horizontal surface/grasp that allows the person to push himself or herself upward from a seated to a standing position or support for steadying a person from and standing to seated position getting into the bed. The handrail member 20 is typically elongated, having a greater length than height, allowing progressive grasping of sections as the user moves to a seated position from a supine position. Alternatively, a different configuration may be suitable for facilitating other desired motions, such as progressively higher grasping portions relative to the user. The tube by which the convolution pattern is created is typically of a diameter to be easily grasped. The distance between the handgrip surfaces of handrail member 20 may be uniform or may vary between sections. The desired distance will allow relatively easy movement between sections, but still requires the patient to use their strength and flexibility. Furthermore, the distance between upper and lower grasping members may similarly be uniform or may vary as desired. The dimensions are preferably designed to allow a person to utilize the base member in a hand-over-hand fashion to assist them in rising and can be distinguished from the configuration of bed rails and the like which are designed to restrain persons and keep them in bed. These grasping surfaces also provide an enhanced grasping area so that a user can use unstructured grabbing patterns and be assured that they will be able to have a surface to grab a hold of.

The rise support 10 may also comprise an elevated curved handle member 34 having a positionable support rod 16 which terminates in a collar 15 having an attachment mechanism, such as a screw or a pin, which selectively attaches the curved handle member 34 relative to the vertical pole 12 in a manner similar to the base handrail member 20. The curved handle member 34 may be positioned to be elevated relative to the base handrail member 20, i.e., it is vertically spaced above the base on the pole relative to the floor.

Figure 6:
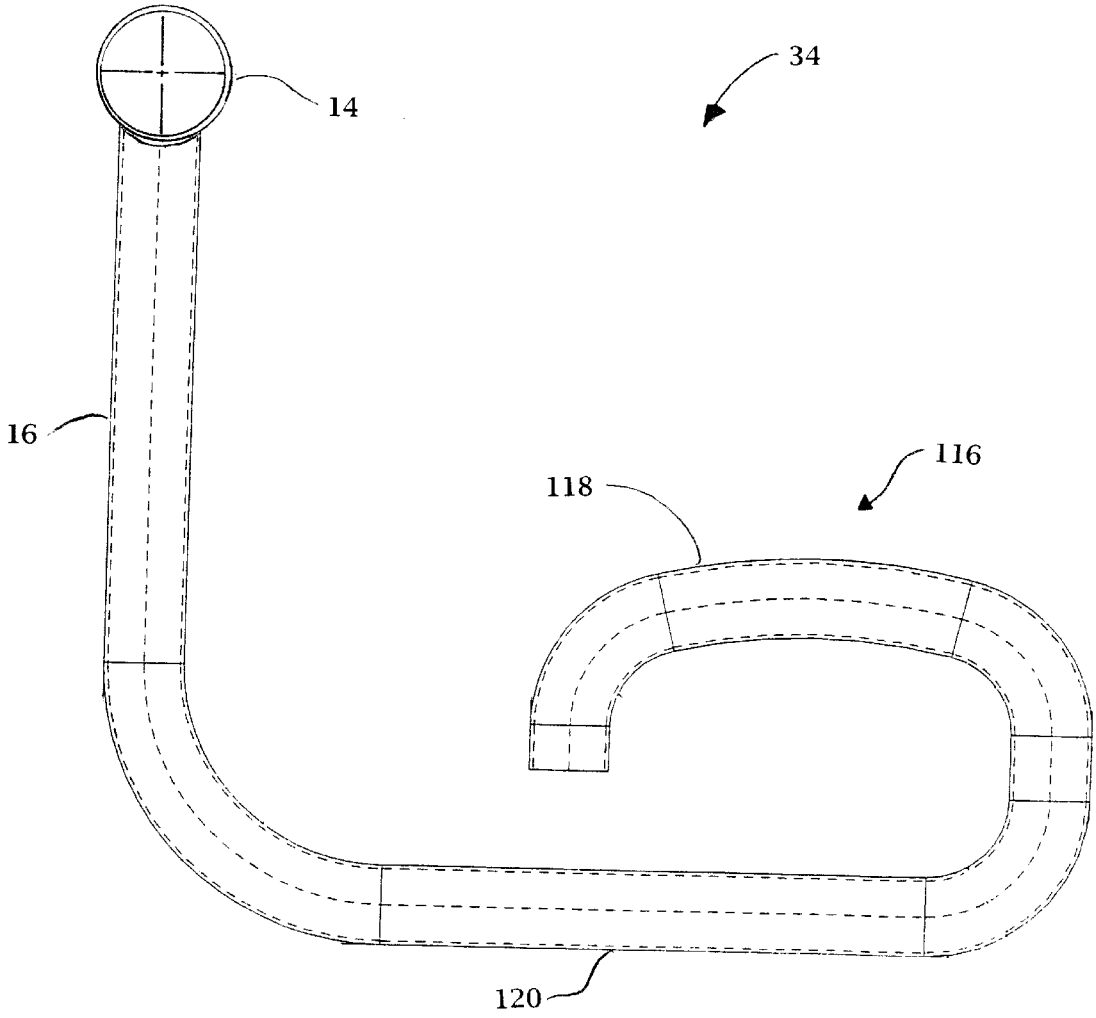
FIG. 6 is a top plan view of a second hand-assist means, which is a part of the present invention.

The curved handle member 34 shown in FIGS. 1 and 6 extends from the support rod 16 and enables the user to reach, using either hand, from the base hand rail member 20 to the curved handle 116 so that the user is provided with assistance to arise from a half-rise position. The curved handle member 34 is generally oval shaped, and may also be formed from a hollow or solid steel bar, or other suitable materials, having an outer diameter of from about 0.5 to about 2.0 inches, preferably from about 1 to about 1.5 inches, and a cross-sectional thickness which is about ⅛ diameter thickness of the pole, i.e., from about ⅛ inch to about 1/16 inch. The handle member 34 as well as handrail member 20 are generally designed to withstand dynamic loading up to the expected loads to be applied, with a safety factor of 3 for a total loading capacity of at least 750 pounds, but any suitable loading capacity is contemplated. The curved handle 116 may have a flat side 120 extending in a perpendicular fashion to the support rod 16 and having a curving, semi-oval portion 118 which is grasped by the user in rising. The curved handle 116 generally has a length along the flat portion 120 of from about 4 inches to about 12 inches, preferably from about 5 inches to about 9 inches, an internal radius on a curved portion from about 3 inches to about 7 inches, preferably from about 4.5 inches to about 5 inches, and an outer diameter of from about 0.5 inch to about 2.0 inches, preferably from about 1 inch to about 1.5 inches. The handle also includes an area such that the curved oval handle 116 projects a distance from the support rod 16 which optimizes the leverage the user can apply to the curved oval portion 118 of the handle relative to the rod, and is from about 4 inches to about 12 inches, and preferably from about 5 inches to about 9 inches. The relative height of the base handrail member 20 to the bed can be adjusted using the corresponding collar means 28, and similarly the relative height of the curved handle member 34 relative to the base member as well as the angle between the support rods 18 and 16 can be adjusted by the positioning of the rods in order to optimize the movement of the user, or to accommodate a particular location or environment. The collars 28, 14 for respective curved handle member 34 and lower handrail member 20 may be from about 1 inch to about 4 inches in depth, and preferably from about 2 inches to about 3 inches.

Figure 7:
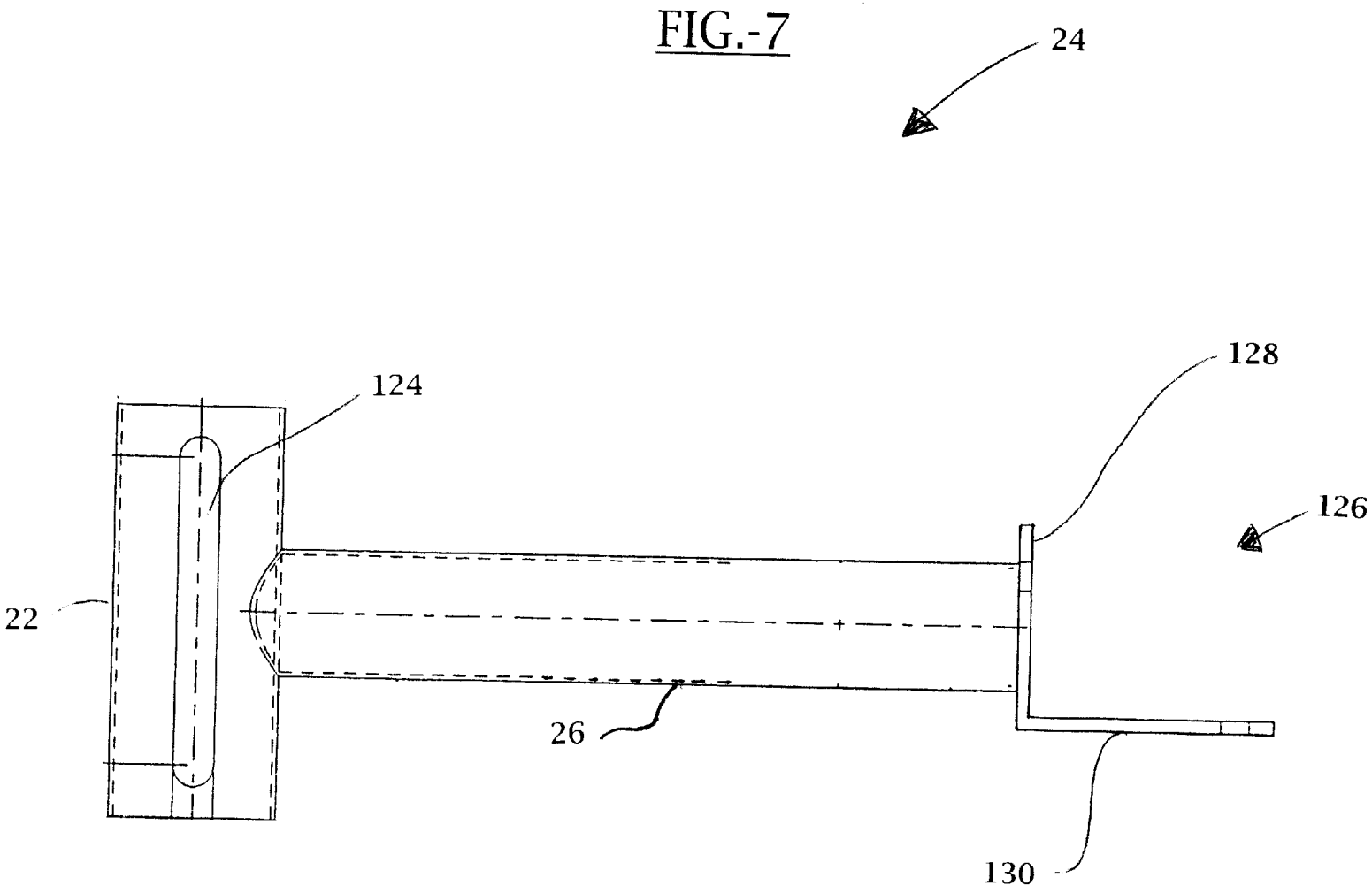
FIG. 7 is an elevational view of the bed attachment means.

The invention also includes a bed frame attachment member 24, shown in detail in FIG. 7 for supporting the vertical pole 12 relative to a stable object, such as a bed. This bed frame attachment member 24 is comprised of a collar 22, connecting rod 26, and a L-bracket 126 that is formed by vertical section 128 and horizontal section 130 which meet at a 90 degree angle and serves the function of extending under the frame of a bed or box springs. Additionally, this bed frame attachment member 24 is capable of infinite vertical adjustment with respect to the vertical pole 12, thereby allowing the L-bracket 126 to be aligned with a bed, bed's frame or other suitable attachment location of the bed. In order to fix the bed frame attachment member in position, the user can insert a pin, compression screw, or other suitable fastener through the slot 124 of the collar 22 and through one of the plurality of through holes located on the vertical pole 12. Additionally, the slot 124 allows for a further "fine" adjustment of the L-bracket's height, whereby the user tightens a compression screw or other fastener capable of exerting a compressive force against the slot 124 of the collar 22 to fix the L-bracket in position. Other fixation systems for the bed frame attachment member 24 are also contemplated, wherein the collar 22 utilizes a fastener such as a compression screw, spring-loaded pin or other fastener capable of exerting a compressive force against the outer wall of the vertical pole 12 are used to hold the bed attachment member 24 in the desired position. It is also contemplated that the bed frame attachment member 24 is horizontally adjustable, thereby allowing the connecting rod 26 to extend or retract so that it can engage a bed or bed's frame, or other suitable attachment location at a desired distance.

The rise support 10 may also include a plurality of vertically adjustable stabilizing feet 63 that are capable of stabilizing and leveling the H-frame base of the rise support 10 with respect to a floor surface. These stabilizing feet 63 may be placed on the bottom surface of the floor contacting members which include: "T" member 55; "T" end tubes 62, 64; strut members 72, 74, or any other suitable surface of the present invention 10.

Figure 8:
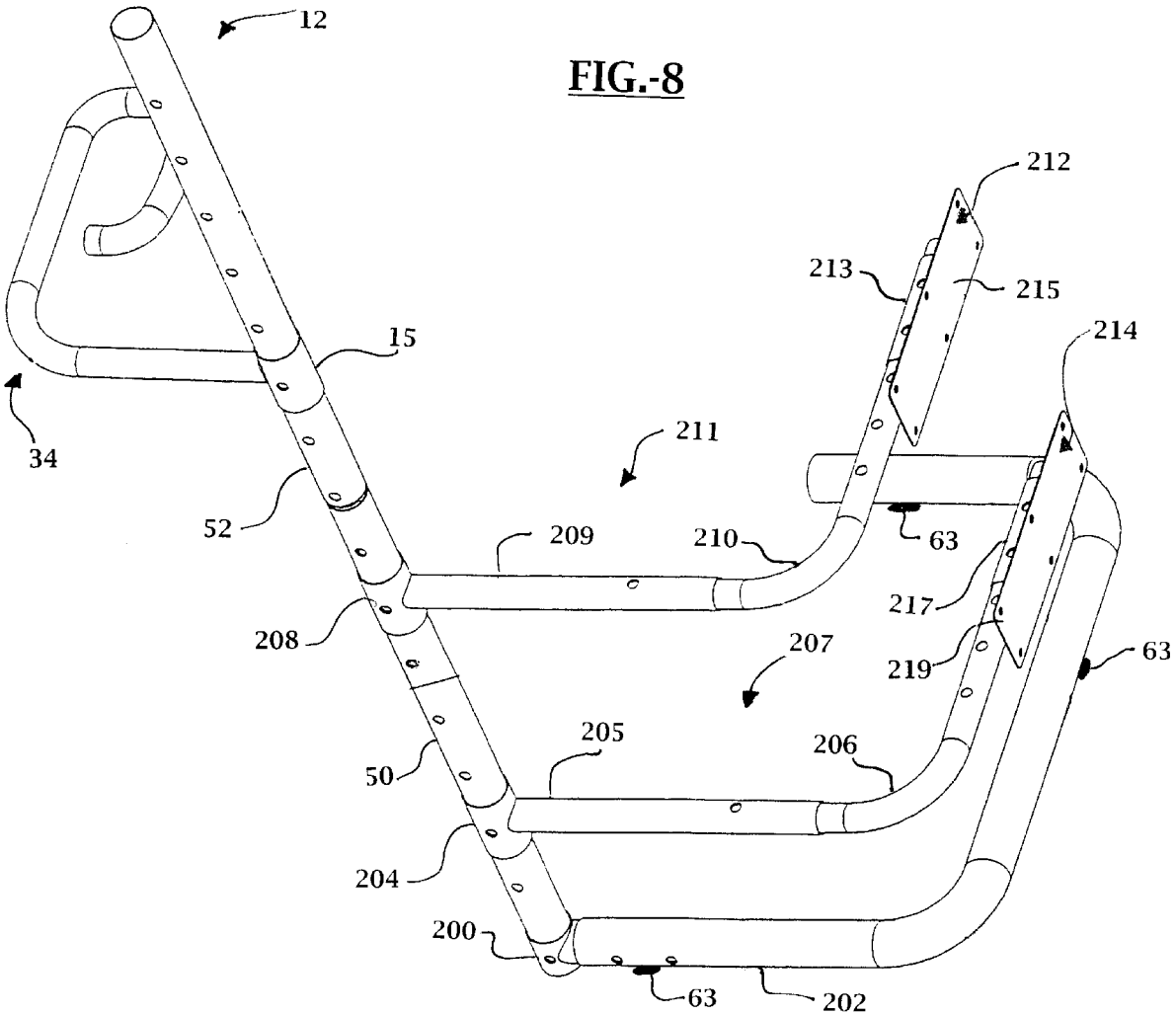
FIG. 8 is a perspective view of a second embodiment of the support pole, with wall attachment means.

The support pole device 10 has tremendous versatility by virtue of its ability to be easily adapted for use with not only a bed but also a chair or similar seating apparatus. This support pole device 10, when configured for use with a chair assists the user in descending into a seated position and provides the user with a source of stability when rising from such a position. The embodiment of the support device as configured for use with a chair is shown in FIG. 8. The support pole 12 is comprised of upper member 52 and lower member 50 which are fastened together by a compression screw or pin that is inserted into the appropriate hole contained in support pole 12. Support pole 12 is inserted into collar 200, which has a tubular extension not shown in FIG. 8 that slides inside of the end of chair support base 202 and is fastened to the base by a pin, compression screw or other suitable means. Located above the chair support base 200 are two L-shaped assemblies 207, 211 that allow the support pole 12 to be mounted to a wall or other similar structure. The lower L-shaped assembly 207 is comprised of a collar 204, support rod 205, and support elbow 206. Support elbow 206 slides inside support rod 205 and is fastened to support rod 205 by a pin, compression screw or other suitable means. Situated above the lower L-shaped assembly 207 is an identical L-shaped structure 211 that is also comprised of a collar 208, support rod 209, and support elbow 210. As in the lower L-shaped assembly, support elbow 210 slides inside support rod 209 and is fastened to support rod 209 by a pin, compression screw or other suitable means. In order to connect the support pole 12 to the wall or other support surface, connection brackets 212 and 214 are used. These brackets 212 and 214 may be comprised of mounting plates 215, 219 and attached tubular sections 213, 217. Mounting plates 215 and 219 may contain holes, which allow the mounting plates 215, 219 to be attached to a wall or similar structure. In addition, both supports 210, 206 and connection brackets 212, 214 may contain holes so that connection brackets 212 and 214 can be slideably adjusted and fastened by a suitable means such as a pin or compression screw to respective support elbows 210 and 206. Attached above both L-shaped attachment structures 211, 207 may be positioned a support member, shown in this embodiment as curved handle member 34 attached to support pole member 12 via collar 15. Furthermore, the user of the support pole device 10 is able to slideably adjust in a vertical direction, the curved handle member 34, and each of the two L-shaped attachment assemblies 207, 211 on the support pole 12. The ability to adjust the height of specific members is achieved by a system of holes or the like, which are integrated into the support pole 12 which will accept a pin, compression screw or any other suitable means of attachment. It is also contemplated that vertically adjustable stabilizing feet may be attached to the bottom of chair support base 202, thereby allowing the user to level and stabilize the rise support 10 with respect to a floor surface.

The components of the device can be made of any suitable material, which has a sufficient strength to bear expected loads, such as enameled sheet metal, or plastic, including for example metal or plastic, such as heat-formed thermoplastics.

What is claimed is:

1. A rise-assist device comprising:

a substantially vertically oriented support pole;

a base comprised of a plurality of support frame members connected to the support pole by at least a first connection member, allowing the base to be positioned in offset relationship to the support pole at a desired distance;

at least one handrail member attached to the support pole, the at least one handrail member comprising a plurality of substantially vertical joined serpentine convolutions, wherein the at least one handrail member has a horizontally and vertically extending serpentine shape; and an attachment member for securing the device to a structure for positioning the at least one handrail at a desired position relative to the structure.

2. A rise-assist device as recited in claim 1, wherein the support pole comprises a plurality of sections connected to one another.

3. A rise-assist device as recited in claim 1, wherein the at least one handrail is formed from a plurality of joined convolutions oriented substantially vertically.

4. A rise-assist device as recited in claim 1, wherein the at least one handrail is adjustably attached to the support pole via a support frame member at a predetermined offset distance relative to the support pole.

5. A rise-assist device are recited in claim 4, wherein the support frame member is attached in offset relationship to the centerline of the rear of the at least one handrail.

6. A rise-assist device as recited in claim 1, wherein the at least one handrail member is vertically adjustable with respect to the support pole.

7. A rise-assist device as recited in claim 1, wherein the base is comprised of a plurality of support surface engaging members having at least one first frame member and at least two second frame members extending laterally to said at least one first frame member.

8. A rise-assist device as recited in claim 7, wherein the at least two second frame members are adjustable with respect to the first frame member thereby allowing the device to accommodate users of various sizes.

9. A rise-assist device as recited in claim 7, wherein the at least one first frame member and the at least two second frame members are adjustable with respect to the support pole.

10. A rise-assist device as recited in claim 1, wherein the base is comprised of a plurality of support surface engaging members with at least one of said engaging members being selectively connected to a substantially vertically oriented support surface.

11. A rise-assist device as recited in claim 1, wherein the base further comprises a plurality of adjustable stabilizers to stabilize the base relative to the support surface.

12. A rise-assist device comprising:

a substantially vertically oriented support pole;

a base comprised of a plurality of support frame members connected to the support pole by at least a first connection member, allowing the base to be positioned in offset relationship to the support pole at a desired distance;

at least one handrail member attached to the support pole, said at least one handrail member comprising a curved, substantially horizontal handle adjustably connected to the support pole at a desired height, wherein the curved handle is comprised of: a first frame section extending horizontally from the support pole; a second frame section extending horizontally in a substantially perpendicular manner with respect to the first frame section; and a curved grasping frame section coupled to the second frame section for grasping by a user, thereby providing leverage relative to the position of the vertical support pole; and an attachment member for securing the device to a structure for positioning the at least one handrail at a desired position relative to the structure.

13. A rise-assist device comprising:

a substantially vertically oriented support pole;

a base comprised of: a plurality of support frame members connected to the support pole by at least a first connection member, allowing the base to be positioned in offset relationship to the support pole at a desired distance; and a plurality of support surface engaging members with at least one of said engaging members being selectively connected to a substantially vertically oriented support surface, wherein the plurality of engaging members include at least one floor engaging member having a plurality of frame members, with at least two of the frame members extending laterally to one another;

at least one handrail member attached to the support pole; and an attachment member for securing the device to a structure for positioning the at least one handrail at a desired position relative to the structure.

14. A rise-assist device comprising:

a substantially vertically oriented support pole;

a base coupled to the support pole to provide stability thereto, and at least first and second hand rail members, the first member comprising a plurality of joined, spaced apart convolutions oriented substantially vertically to provide a plurality of alternating substantially vertical and horizontal grasping surfaces joined by curved sections, and the second member comprising a first frame section extending substantially horizontally from the support pole, a second frame section extending substantially horizontally in a substantially perpendicular manner with respect to the first frame section, and a curved grasping frame section coupled to the second frame section for grasping by a user.

* * * * *